US012605590B2

(12) United States Patent
Carolan-Taddonio et al.

(10) Patent No.: US 12,605,590 B2
(45) Date of Patent: Apr. 21, 2026

(54) IN-WATER ROWING EXERCISE MACHINE

(71) Applicant: Linda Carolan-Taddonio, St Paul, MN (US)

(72) Inventors: Linda Carolan-Taddonio, St Paul, MN (US); Robert Tuttle, Eden Prairie, MN (US); Alan Littman, Lakeville, MN (US); Reed Johnson, Minneapolis, MN (US)

(73) Assignee: Row H2O, Inc.

( * ) Notice: Subject to any disclaimer, the term of this patent is extended or adjusted under 35 U.S.C. 154(b) by 155 days.

(21) Appl. No.: 18/647,119

(22) Filed: Apr. 26, 2024

(65) Prior Publication Data

US 2025/0332474 A1 Oct. 30, 2025

(51) Int. Cl.
*A63B 22/00* (2006.01)
*A63B 21/00* (2006.01)
(Continued)

(52) U.S. Cl.
CPC ..... *A63B 22/0076* (2013.01); *A63B 21/0084* (2013.01); *A63B 21/0442* (2013.01); *A63B 21/0552* (2013.01); *A63B 21/169* (2015.10); *A63B 21/4034* (2015.10); *A63B 21/4035* (2015.10); *E04H 4/14* (2013.01); *A63B 2022/0079* (2013.01); *A63B 2208/03* (2013.01); *A63B 2225/09* (2013.01)

(58) Field of Classification Search
CPC ..... A63B 21/0084; A63B 21/0442; A63B 21/0552; A63B 21/169; A63B 21/4034; A63B 21/4035; A63B 22/0076; A63B 2022/0079; A63B 69/06; A63B 69/08; A63B 2069/062; A63B 71/0036; A63B 2208/03; A63B 2210/50; A63B 2225/09; A63B 2225/60
See application file for complete search history.

(56) References Cited

U.S. PATENT DOCUMENTS 3,859,990 A * 1/1975 Simon ..... A61H 9/00 601/156
4,247,096 A * 1/1981 Schmitt ..... A63B 69/12 273/DIG. 30
(Continued)

FOREIGN PATENT DOCUMENTS

JP H08252193 A * 10/1996
WO WO-2025090399 A1 * 5/2025 ..... B63C 9/26

*Primary Examiner* — Gary D Urbiel Goldner

(57) ABSTRACT

An in-water rowing exercise device comprises a vertical metal post configured to be positioned against a wall of a pool and an adjustable footrest, configured to be fully submerged, attached proximate to a bottom portion of the post. A bracket is horizontally attached to an upper portion of the post proximate to a water level of the pool. Two resistance bands, each with a handle, are attached to the bracket. The bands enable a user with body partially submerged, facing the wall in a partially sitting position, with arms and legs at least partially bent, with feet on the footrest, to grasp and pull the bands toward a shoulder area via the handles and extend user legs until reaching a near-supine and upward facing position. The device enables the bands to return to a non-extended resting position, thus returning the user from the near-supine position to the partially sitting position.

17 Claims, 4 Drawing Sheets

(51) Int. Cl.

| | |
|---|---|
| ***A63B 21/008*** | (2006.01) |
| ***A63B 21/04*** | (2006.01) |
| ***A63B 21/055*** | (2006.01) |
| ***A63B 21/16*** | (2006.01) |
| ***E04H 4/14*** | (2006.01) |

(56) References Cited

U.S. PATENT DOCUMENTS

| | | | | | |
|---|---|---|---|---|---|
| 4,875,673 | A * | 10/1989 | Erickson | A63B 1/00 | 482/41 |
| 5,344,373 | A * | 9/1994 | Greene | A63B 69/12 | 482/121 |
| 5,385,525 | A * | 1/1995 | Davis | A63B 21/0552 | 482/121 |
| 5,554,091 | A * | 9/1996 | Patey | A63B 21/4011 | 482/121 |
| 6,251,049 | B1 * | 6/2001 | Milton | A63B 69/12 | 434/254 |
| 6,905,444 | B2 * | 6/2005 | Milton | A63B 69/12 | 434/254 |
| 7,442,151 | B1 * | 10/2008 | Berdegue | A63B 69/12 | 434/254 |
| 10,596,438 | B1 * | 3/2020 | Gambrell | A63B 31/00 | |
| 2023/0073056 | A1 * | 3/2023 | Hales | A61H 33/6005 | |

* cited by examiner

IN-WATER ROWING EXERCISE MACHINE

CROSS REFERENCE TO RELATED APPLICATIONS

None

FIELD OF THE DISCLOSURE

The present disclosure is in the field of exercise devices. More particularly, the present disclosure provides an in-water rowing device in which a mostly submerged user in a pool affixes their feet to a stationary footrest and grasps and pulls resistance bands up to their shoulders while extending their legs in a rowing motion, thereby receiving significant exercise benefits.

BACKGROUND

A typical indoor rowing machine is a device that simulates the action of rowing. Indoor rowing has become a popular full body cardiovascular workout. Indoor rowing machines are commonly found in health clubs, home gyms, hotel gyms, and other exercise venues. Rowing offers a low-impact, high-intensity workout that has many health benefits for the body. Rowing can help develop strength in individual body parts such as the arms, legs, and core, improve cardiovascular health, increase endurance, and burn calories. Also, rowing is a low-impact workout that is easier on the joints compared to high-impact exercises such as jogging and running. A rowing machine can assist a user in reaching fitness objectives and enhancing general health and well-being if used regularly. Rowing carries very little risk of injury.

Many rowing machines feature digital displays that provide feedback on distance, time, strokes per minute, and other workout metrics. These features make it easier for users to track progress and set fitness goals.

DETAILED DESCRIPTION

Figure 1:
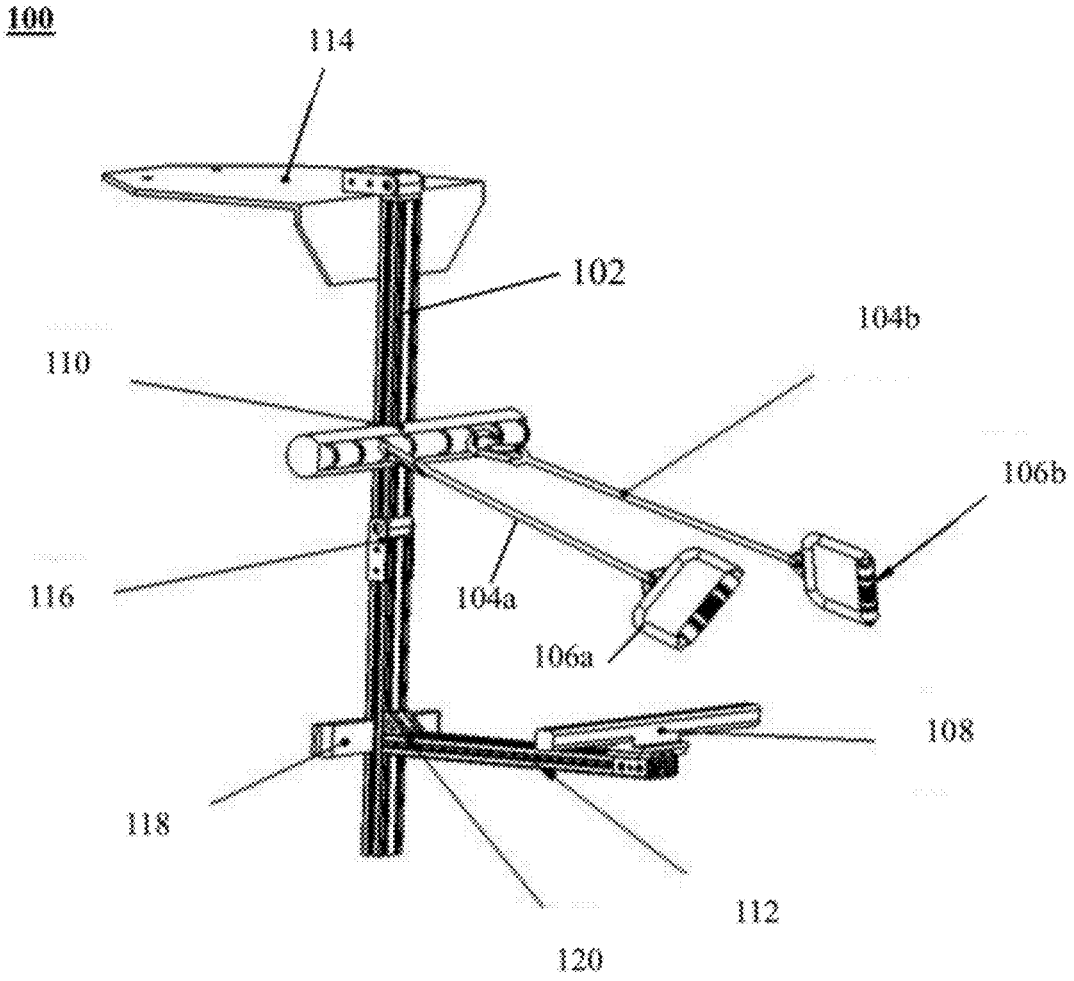
FIG. 1 is a diagram of a system of an in-water rowing exercise machine according to an embodiment of the present disclosure.

Systems and methods described herein provide an in-water exercise and fitness device, essentially a rowing device without a seat wherein the user is supported by water's buoyancy instead of a seat. A partially submerged user places his/her feet on a submerged footrest, grasps handles attached to resistance bands at the water's surface.

The user pulls the bands in a continuous fully body extension and contraction rowing motion. The user pushes using leg strength while pulling the bands toward himself/herself in the rowing motion. When the bands are fully pulled, the user's legs are extended, and the user has shifted from a sitting position in the water to a fully supine or laying down and upward facing position.

The footrest and the horizontal bar to which the bands are attached are affixed to a vertical post positioned against the side of a pool in which the user is partially immersed. The vertical post suspends downward from the edge or apron of the pool and is held firmly there by a mounting device.

A user is initially in a sitting position and facing the wall and vertical post. The user's feet are on the footrest and hands are holding the handles with the bands extended in relaxed state. The user's head is out of the water. The user's feet remain stationary on the footrest which is positioned near the bottom of the vertical post throughout the exercise.

As noted, while holding the handles of the resistance bands, the user then extends his/her body backward away from the wall by pushing with his/her legs against the footrest to extend the legs while pulling the handles to the shoulders, thereby creating tension in the bands during the rowing motion. When the user has reached the desired level of extension, the user can then reverse his/her action and return to the original sitting and relaxed state to begin the next row. Engaging in this cycle repeatedly and continuously in a rowing motion can provide significant cardio-vascular and strength building exercise.

Indoor rowing machines typically found at health clubs do not harness the additional benefits of natural resistance and the soothing ambiance of an immersive water experience. Systems and methods described herein bridge this gap, providing the fitness benefits of a traditional rowing machine in an immersive water experience that adds complimentary natural resistance and tranquility to the exercise. Systems and methods may cater to a broad audience ranging from fitness enthusiasts to rehabilitation patients.

Systems and methods provide the following benefits:

1. Resistance Variation: Water provides complimentary natural resistance to the resistance mechanism built into the machine. This offers a smoother and more fluid rowing motion than a traditional rower.

2. Low-Impact: Water rowing gently improves joint flexibility due to its low-impact nature enhanced by the water, making it beneficial for individuals with joint issues or those recovering from injuries.

3. Cooling Effect: Being in the water can have a cooling effect, which may be particularly refreshing during warmer weather.

Noteworthy unique emotional benefits include:

1. Water Therapy: Water has a calming effect on the mind, and the rhythmic motion of rowing can be therapeutic, helping to reduce stress and anxiety.

2. Scenic Enjoyment: Rowing in water outdoors can provide a scenic and tranquil environment, contributing to a sense of calm and relaxation.

3. Connection with Nature: Being surrounded by water can enhance the overall experience, promoting a sense of connection with an outdoor environment when used outdoors.

The in-water rowing device is designed to be portable and easily stored. The device is designed to be used in various bodies of water including in-ground outdoor swimming pools, above ground outdoor swimming pools, swim spas, indoor swimming pools in fitness centers or therapy centers, lakes with access to a dock or similar support structure or other body of water that is at least ten feet long, seven feet wide and four feet deep. The unit can be stored and transported in a suitcase or similar carrying device for ease of portability.

The rowing machine is designed for various users regardless of height, weight, or physical limitations that do not restrict the ability to perform a rowing motion.

While not shown in the figures, the device features a quick-release mechanism for attachment and detachment to the structure next to the water to keep the rowing device from moving while in use. Attachment options comprise in-ground anchor kits, hooks, and in-ground supports although these options are not shown in the figures.

The handles are coated with a non-slip, skin-friendly material and are ergonomically designed for maximum grip and comfort. The resistance bands are coated with a chlorine-resistant material to extend longevity. Bands may be selected by level of resistance and clipped onto the unit for use. Multiple bands can be used together to increase resistance if desired. In some embodiments, the system may incorporate battery operated resistance motors to create a proper two-way resistance.

The metal parts of the system may be constructed from corrosion-resistant materials such as stainless steel or treated aluminum to withstand prolonged exposure to water. The system incorporates anti-slip materials at critical contact points with swimming pools, boat docks, or other supporting structure.

While not illustrated in the figures, the system may be configured with Bluetooth waterproof speakers and a Bluetooth wearable accessory that allow users to select an experience rowing on various bodies of water, such as Trippy Waterproof VR and Ballast Headset. The system may be compatible with exercise applications that include a rowing option, such as the Apple watch. In embodiments, an IP68 waterproof display may be mounted to the system which may display time and performance metrics such as strokes per minute, estimated calories burned, and total distance rowed. Such metrics may be provided by sensors mounted in the system.

A connected Bluetooth app may provide data unique to performing a rowing motion in the water where the additional resistance and temperature of the water impacts body temperature and perspiration characteristics to affect performance statistics of the workout. Waterproof cases may be provided for electronic devices such as phones or iPad devices with the ability to use voice commands to control applications on the devices.

Turning to the figures, FIG. 1 is a diagram of a system of an in-water rowing exercise machine according to an embodiment of the present disclosure. FIG. 1 illustrates components and interactions of a system 100 of such an embodiment.

The system 100 comprises a foldable vertical post 102, resistance bands 104*a-b*, corrosion resistant handles 106*a-b*, footrest 108, and a variable width and height for resistance bands 110, referred to interchangeably herein as a bands bracket 110. The system 100 also comprises a footrest extension 112, a mounting plate 114, a hinge 116, a wall stabilizer 118, and a variable footrest height adjuster 120. The foldable vertical post 102, the resistance bands 104*a-b*, and the corrosion resistant handles 106*a-b* may be referred to hereinafter for brevity as the post 102, the bands 104*a-b*, and the handles 106*a-b*, respectively.

The post 102 may be made of a steel or other metal, plastic, wood or other material and is positioned vertically on wall surface of a pool or other body of water. The mounting plate 114 attaches to the post 102 and is affixed or clamped to a pool edge, apron or other structure to hold the post 102 in place such that the post does not come loose to pull away from the wall. A lower end of the post 102 may adhere to or be stabilized against the wall of the pool by the wall stabilizer 118.

The post 102 may not be a single continuous component but may in embodiments be segmented into at least two segments and connected by at least one hinge 116 that allows folding of the post 102 for placement into a carrying case or similar device.

The bands 104*a-b* may be made of rubber or other elastic material and stretch when pulled by a user via the handles 106*a-b*. The bands 104*a-b* may be provided in various lengths and varying weight resistance for users of differing needs and preferences. The bands 104*a-b* attach to the bands bracket 110 which is generally positioned at or near the surface of the pool water.

As is evident from the figures, the bands 104*a-b* may have hooks allowing the bands 104*a-b* to attach to loops on the bands bracket 110. The level of the bands bracket 110 is adjustable along the vertical length of the post 102. The bands 104*a-b* attach to the bands bracket 110 at various attachment points or hooks along the surface of the bands bracket 110.

The footrest 108 is stationary and does not move during use by a user. The footrest extension 112 allows the distance from the footrest 108 to the post 102 to be adjusted for the height of various users. The variable footrest height adjuster 120 is a clamping or latching device which enables the footrest extension 112 to be moved up or down the post 102 and be firmly affixed thereto. The length of the footrest extension 112 may also be changed such that the user's feet may be closer to or more distant from the wall of the pool, allowing the user to achieve a desired amount of leverage for his or her legs. The variable footrest height adjuster 120 is used to affix the footrest extension 112 to the post. In FIG. 1, the positioning of the variable footrest height adjuster 120 and the footrest 112 are such that these two components are connected to the wall stabilizer 118. Positioning of the variable footrest height adjuster 120 and the footrest 112 are unrelated to positioning of the wall stabilizer 118.

Figure 2:
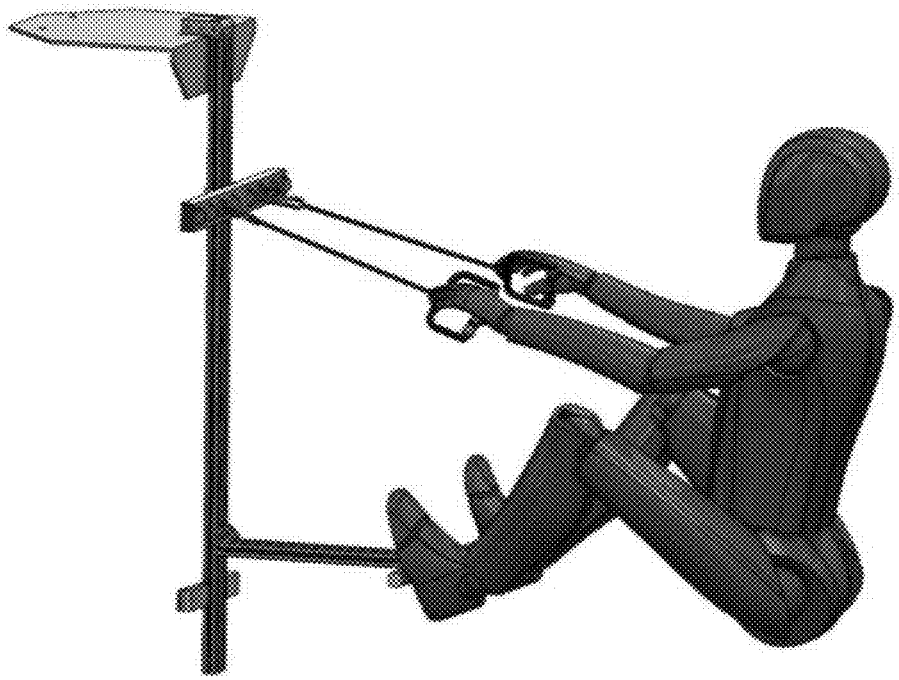
FIG. 2 is a diagram of a system of an in-water rowing exercise machine according to an embodiment of the present disclosure.
Figure 3:
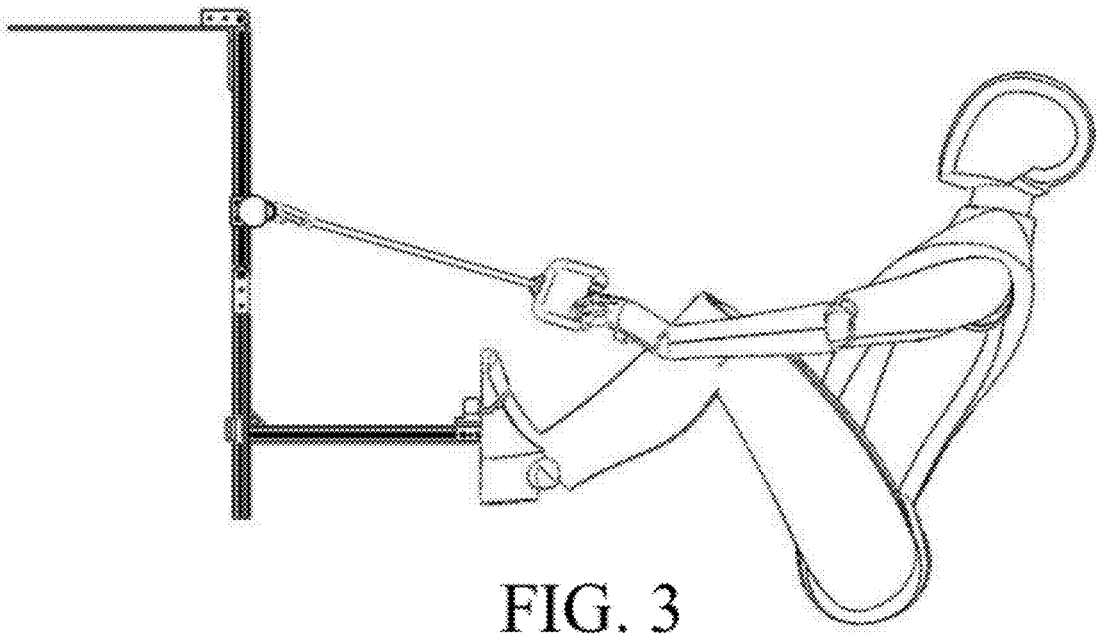
FIG. 3 is a diagram of a system of an in-water rowing exercise machine according to an embodiment of the present disclosure.

FIG. 2 and FIG. 3 are diagrams of a system of an in-water rowing exercise device according to an embodiment of the present disclosure. FIG. 2 and FIG. 3 depict an image of dummy representing a human user in the beginning position in which arms and knees are bent, the upper body is in a sitting position, and the bands 104*a-b* are not stretched, but are taut. The system 100 does not include a seat. Therefore buoyancy in the water allows a user to assume the position shown in FIG. 2 and FIG. 3.

Figure 4:
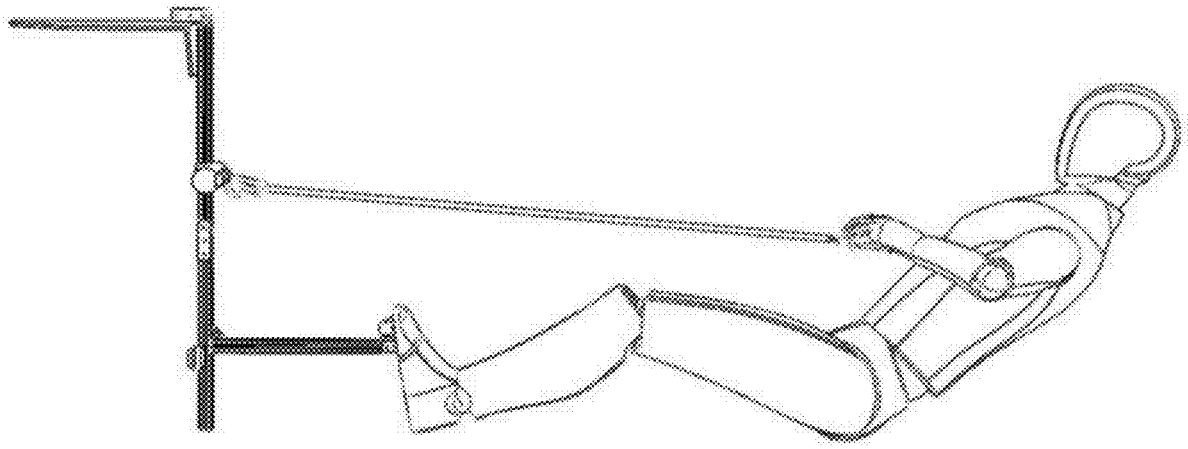
FIG. 4 is a diagram of a system of an in-water rowing exercise machine according to an embodiment of the present disclosure.

FIG. 4 is a diagram of a system of an in-water rowing exercise machine according to an embodiment of the present disclosure. FIG. 4 depicts an image of dummy representing a human user in the extended position in which arms and knees are extended, the upper body is supine or flat, and the bands 104*a-b* are stretched.

Figure 5:
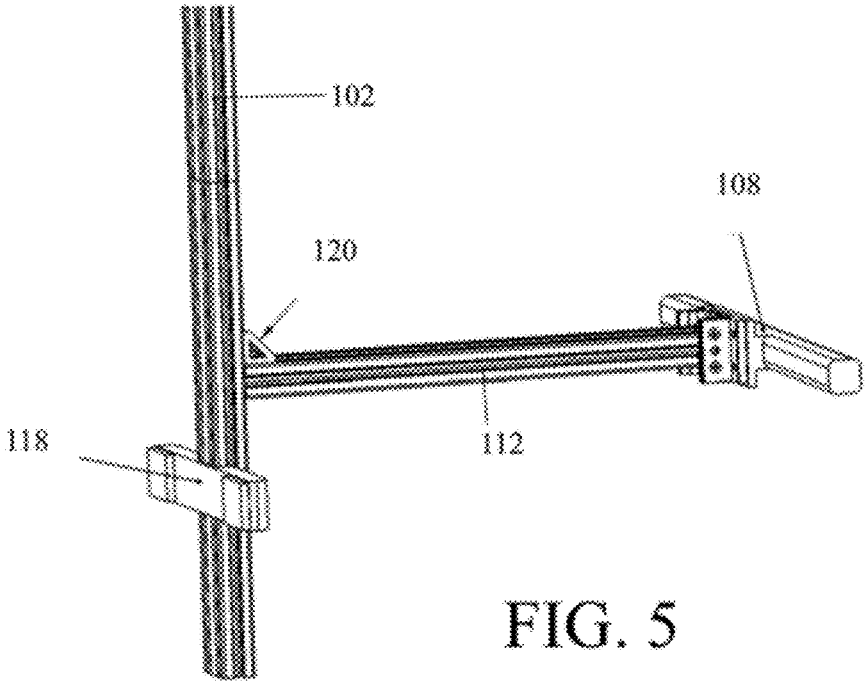
FIG. 5 is a diagram of a system of an in-water rowing exercise machine according to an embodiment of the present disclosure.

FIG. 5 is a diagram of a system of an in-water rowing exercise machine according to an embodiment of the present disclosure. FIG. 5 depicts some components of the system 100 of an in-water rowing exercise machine including the post 102, footrest 108, footrest extension 112, the wall stabilizer 118, and the variable footrest height adjuster 120.

Figure 6:
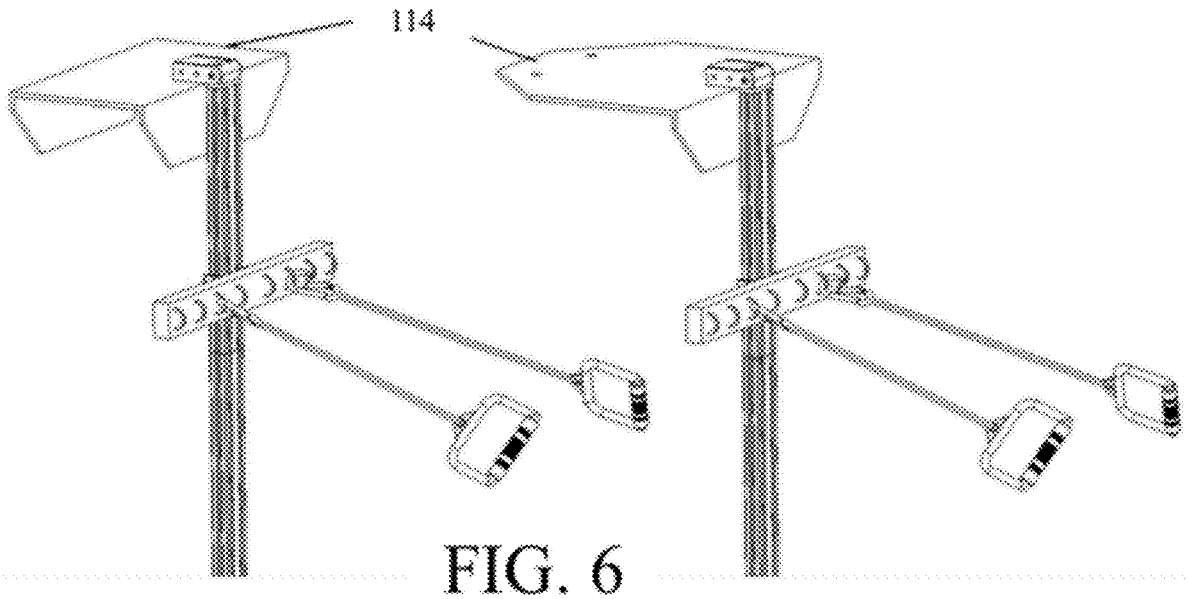
FIG. 6 is a diagram of a system of an in-water rowing exercise machine according to an embodiment of the present disclosure.

FIG. 6 is a diagram of a system of an in-water rowing exercise machine according to an embodiment of the present disclosure. FIG. 6 depicts two different versions of the mounting plate 114 used to mount the entire system 100 to an edge of pool or other body of water. The mounting plate 114 can be engineered to fit a number of different structures such that the system stays in place and does not pull loose. The system may work with inground outdoor swimming pools, above ground outdoor swimming pools, swim spas, indoor swimming pools in fitness centers or therapy centers, or lakes with access to a dock such that the mounting plate 114 may be adapted in a variety of ways to hold the system 100 in place.

Figure 7:
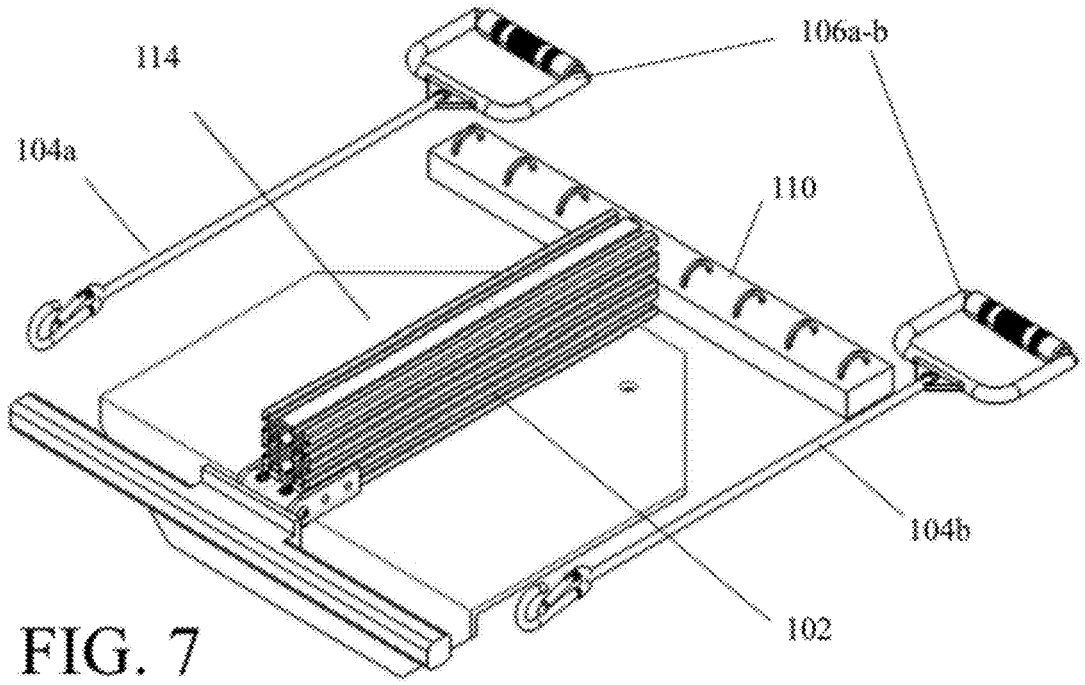
FIG. 7 is a diagram of a system of an in-water rowing exercise machine according to an embodiment of the present disclosure.

FIG. 7 is a diagram of a system of an in-water rowing exercise machine according to an embodiment of the present disclosure. As noted above, the system 100 is collapsable and may be stored in a carrying case. The system 100 is shown in collapsed state in FIG. 7 such that it may fit into a carrying case.

As used herein, the terms resistance bands and elastic bands indicate the same component and may be used interchangeably. As used herein, the terms system, device, and machine indicate the same component(s) and may be used interchangeably. The terms machine and device include all components provided by the term system unless specifically stated otherwise. As used herein, the term pool may indicate swimming pool.

The system further comprises a quick release mechanism allowing the post 102 and attached components to be removed with relatively little effort from the mounting plate 114 which may be affixed in a semi-permanent manner to a pool apron. A user may then store the post 102 and attached components until next use. After the post 102 and attached other components have been removed, the mounting plate 114, which may be bolted or mounted in the more semi-permanent manner to the pool, remains in place. Users may use a pool cover as the mounting plate 114 is a flat panel and would not interfere placement and removal of a pool cover.

In an embodiment, a system of an in-water rowing exercise device is provided. The system comprises a vertical metal post positioned against a wall of a pool and an adjustable footrest attached proximate a bottom portion of the post, the footrest fully submerged. The system also comprises two resistance bands, each band with a handle, the bands attached to a bracket horizontally attached to an upper portion of the post proximate a water level. The bands promote a user with body partially submerged, facing the wall in a partially sitting position, with arms and legs at least partially bent, and with feet on the footrest, to grasp and pull the bands toward a shoulder area via the handles and extend user legs until reaching a near supine and upward facing position. The system also promotes the user to allow the bands to return to non-extended and a resting position, thus returning the user from the supine position to the partially sitting position.

The promoted user actions, when engaged in repeatedly and continuously, create a rowing motion. The post is suspended from an edge of the pool via a mounting device.

Positioning of the footrest on the post is adjustable to accommodate needs of various users. Length of the resistance bands is adjustable to accommodate various users.

A lower portion of the post is affixed to the wall to prevent the post from moving in a side-to-side manner and to prevent the post from being pulled away from the wall. The post is segmented into portions, the portions connected by hinges and latches, segmenting of the post promoting collapsing of the post for placement into a carrying device.

The system does not include a seat such that the user is supported by buoyancy of water in the pool. The system accommodates alternate user positioning to perform additional resistance exercises in the pool wherein the user faces downward and away from the wall and pulls the elastic bands over the user's shoulders in a fly motion or other similar exercises.

In another embodiment, a method of exercising using an in-water rowing exercise machine is provided. The method comprises a first elastic band and a second elastic band, each band attached at a first end to a bracket, receiving user manual grasping of handles, each of two handles attached to a second end of one of the first and the second band. The method also comprises the bands receiving extension based on a pulling action by a user via the handles. The method also comprises the bands returning to a resting and non-stretched state based on a discontinuance of the pulling action.

The method also comprises the bracket attaching to a vertical post suspended from an edge of a pool into water held by the pool. The method also comprises a footrest attached to the vertical post below a location of the bracket and fully submerged.

The method also comprises the resistance bands receiving the extension and returning to a resting and non-stretched state based on a user engaging in a rowing motion while partially submerged in the pool. The rowing motion is facilitated by placement of user's feet on the footrest. The rowing motion is facilitated by the user facing a wall of the pool and the post in a partially sitting position and with feet on the footrest, the user pulling the bands via the handles until reaching a near supine position with arms and legs fully extended, followed by the user allowing the bands to return to resting position, thus returning the user from the supine position to the partially sitting position.

In yet another embodiment, an in-pool exercise device is provided. The device comprises two resistance bands attached at first ends to a bracket, the bracket attached to a post vertically positioned against a wall of a swimming pool, the bracket located one of at and proximate to a water level of the pool. The device also comprises a footrest attached to the post below the bracket, the footrest fully submerged. The device also comprises two handles, one each attached to second ends of the elastic bands. The handles receive pulling action by a user in a sitting position in the pool with feet on the footrest, the pulling action stretching the bands and promoting the user to attain a near supine position in the water with arms and legs fully extended. The handles also receive discontinued pulling action, the discontinued action resulting in discontinuance of the stretching and promoting the user to return to the sitting position. Repeated and continuous pulling action followed by discontinued pulling action combined with respective attainment of supine position and return to sitting position promote a rowing action.

The system does not include a seat such that the user is supported by buoyancy provided by water in the pool. Positioning of the bracket, positioning of the footrest, and length of the elastic bands are adjustable to accommodate various user needs.

A portion of the post is affixed to the wall to prevent the post from moving in a side-to-side manner and to prevent the post from being pulled away from the wall. The post is segmented into portions, the portions connected by hinges and latches, segmenting of the post promoting folding of the post for placement into a carrying device.

What is claimed is:

1. A system of an in-water rowing exercise device, comprising:

a post being vertical and metal, wherein the post is configured to be positioned against a wall of a pool holding water and suspended from an edge of the pool via a mounting device;

an adjustable footrest attached proximate to a bottom portion of the post, the adjustable footrest configured to be fully submerged in the pool;

a bracket horizontally attached to an upper portion of the post and configured to be proximate to a water level of the pool; and two resistance bands, each resistance band having a handle, the two resistance bands attached to the bracket and having an extended active position and a non-extended resting position, wherein:

the extended active position of the two resistance bands is configured to enable a user with a body of the user partially submerged, facing the wall in a partially sitting position, with arms and legs of the user at least partially bent, and with feet of the user on the footrest, to grasp and pull the two resistance bands toward a shoulder area of the user via the handles and extend the legs of the user until reaching a near-supine and upward facing position; and the non-extended resting position of the two resistance bands is configured to enable the user to return from the near-supine and upward facing position to the partially sitting position.

2. The system of claim 1, wherein the extended active position followed by the non-extended resting position, when engaged in repeatedly and continuously, creates a rowing motion.

3. The system of claim 1, wherein positioning of the footrest on the post is adjustable to accommodate needs of various users.

4. The system of claim 1, wherein a length of the two resistance bands is adjustable to accommodate various users.

5. The system of claim 1, wherein a bottom portion of the post is configured to be affixed to the wall to prevent the post from moving in a side-to-side manner and to prevent the post from being pulled away from the wall.

6. The system of claim 1, wherein the post is segmented into portions, the portions are connected by hinges and latches, and segmenting of the post enables collapsing of the post for placement into a carrying device.

7. The system of claim 1, wherein the system is configured without a seat such that the user is supported by a buoyancy of water in the pool.

8. The system of claim 1, wherein the system is configured to accommodate alternate user positioning to perform additional resistance exercises in the pool wherein the user faces downward and away from the wall and pulls the two resistance bands over shoulders of the user in a fly motion or other similar exercises.

9. A method of exercising using an in-water rowing exercise machine, the in-water rowing exercise machine comprising:

a first elastic band and a second elastic band, each of the first and second elastic bands attached at a first end to a bracket;

a vertical post to which the bracket is attached;

a footrest attached to the vertical post below a location of the bracket; and two handles respectively attached to a second end of the first and second elastic bands;

wherein the method comprises:

providing the in-water rowing exercise machine;

suspending the vertical post from an edge of a pool into water held by the pool and positioning the vertical post against a wall of the pool;

fully submerging the footrest into the pool of water;

grasping the two handles with hands of a user;

performing a pulling action by the user via the two handles wherein the first and second elastic bands are stretched into an extended active position; and discontinuing the pulling action wherein the first and second elastic bands are returned to a non-extended resting position.

10. The method of claim 9, further comprising the step of performing the pulling action followed by the step of discontinuing the pulling action, repeatedly and continuously, to create a rowing motion, and wherein the user engages in the rowing motion while being partially submerged in the pool of water.

11. The method of claim 10, wherein the rowing motion is facilitated by placement of feet of the user on the footrest.

12. The method of claim 10, wherein the rowing motion is facilitated by the user facing a wall of the pool and the vertical post while the user is in a partially sitting position and with feet of the user on the footrest, the user pulling the first and second elastic bands into the extended active position via the two handles until reaching a near-supine position with arms and legs of the user fully extended, followed by the user allowing the first and second elastic bands to return to the non-extended resting position, thus returning the user from the near-supine position to the partially sitting position.

13. An in-pool exercise device, comprising:

two resistance bands attached at first ends to a bracket, the bracket attached to a post configured to be vertically positioned against a wall of a swimming pool holding water, the post configured to be suspended from an edge of the swimming pool via a mounting device, and the bracket configured to be located at or proximate to a water level of the swimming pool;

a footrest attached to the post below the bracket, the footrest configured to be fully submerged in the swimming pool; and two handles respectively attached to second ends of the two resistance bands, the two resistance bands having an extended active position and a non-extended resting position, wherein:

the extended active position of the two resistance bands is configured to receive pulling action by a user in a sitting position in the swimming pool with feet of the user on the footrest and hands of the user respectively grasping the two handles, the pulling action stretching the two resistance bands and enabling the user to attain a near-supine position in the water with arms and legs of the user fully extended; and the non-extended resting position of the two resistance bands is configured to receive discontinued pulling action, the discontinued pulling action resulting in discontinuance of the stretching of the two resistance bands and enabling the user to return to the sitting position;

wherein the extended active position configured to be combined with attainment of the near-supine position followed by the non-extended resting position configured to be combined with attainment of the return to the sitting position, when engaged in repeatedly and continuously, creates a rowing action.

14. The device of claim 13, wherein the device is configured without a seat such that the user is supported by a buoyancy provided by the water in the swimming pool.

15. The device of claim 13, wherein positioning of the bracket, positioning of the footrest, and a length of the two resistance bands are adjustable to accommodate various user needs.

16. The device of claim 13, wherein a portion of the post is configured to be affixed to the wall of the swimming pool to prevent the post from moving in a side-to-side manner and to prevent the post from being pulled away from the wall of the swimming pool.

17. The system of claim 13, wherein the post is segmented into portions, the portions are connected by hinges and latches, and segmenting of the post enables folding of the post for placement into a carrying device.

* * * * *